US009574790B2

(12) United States Patent
Hasegawa et al.

(10) Patent No.: US 9,574,790 B2
(45) Date of Patent: Feb. 21, 2017

(54) AIR DUCT AND AIR FLOW SYSTEM

(71) Applicant: TIGERS POLYMER CORPORATION, Osaka (JP)

(72) Inventors: Minoru Hasegawa, Hyogo (JP); Seisuke Okabe, Hyogo (JP)

(73) Assignee: TIGERS POLYMER CORPORATION, Osaka (JP)

( * ) Notice: Subject to any disclaimer, the term of this patent is extended or adjusted under 35 U.S.C. 154(b) by 0 days.

(21) Appl. No.: 14/867,560

(22) Filed: Sep. 28, 2015

(65) Prior Publication Data

US 2016/0320089 A1 Nov. 3, 2016

(30) Foreign Application Priority Data

May 1, 2015 (JP) ..... 2015-094128

(51) Int. Cl.
*F24F 13/24* (2006.01)

(52) U.S. Cl.
CPC ..... *F24F 13/24* (2013.01); *F24F 2013/242* (2013.01)

(58) Field of Classification Search
CPC ..... F24F 13/24
USPC ..... 181/224, 229
See application file for complete search history.

(56) References Cited

U.S. PATENT DOCUMENTS 6,622,680 B2 9/2003 Kino
6,959,679 B2 * 11/2005 Concialdi ..... F02B 27/00 123/184.57
7,141,101 B2 * 11/2006 Amann ..... B01D 46/0023 181/229
2003/0062013 A1 4/2003 Kino
2009/0166126 A1 * 7/2009 Patsouras ..... B29C 43/18 181/224
2009/0178879 A1 * 7/2009 Park ..... B01D 46/10 181/224
2010/0044149 A1 * 2/2010 Patel ..... F16L 55/033 181/224
2014/0251719 A1 * 9/2014 Feld ..... F02M 35/1272 181/229
2014/0299406 A1 * 10/2014 Librett ..... A61M 16/0069 181/224
2015/0101883 A1 * 4/2015 Xu ..... F24F 13/082 181/224

FOREIGN PATENT DOCUMENTS

JP 2001323853 A2 11/2001
JP 2009281166 A2 12/2009

* cited by examiner

*Primary Examiner* — Forrest M Phillips

(74) *Attorney, Agent, or Firm* — Rankin, Hill & Clark LLP

(57) ABSTRACT

An air duct of this disclosure includes: a tubular duct body formed from a non-air-permeable material; and a tubular opening end member formed from an air-permeable material. The opening end member is integrated with an end portion of the duct body so as to extend a duct wall of the duct body. D representing a diameter of the opening end member and L representing a length thereof satisfy a relationship $0.1D \leq L \leq 1.5D$. An air permeability of the air-permeable material is in a range of 0.3 to 100 sec/300 cc.

6 Claims, 10 Drawing Sheets

AIR DUCT AND AIR FLOW SYSTEM

CROSS-REFERENCE TO RELATED APPLICATION

This application is based on Japanese Patent Application No. 2015-094128 filed with the Japan Patent Office on May 1, 2015, the entire content of which is hereby incorporated by reference.

BACKGROUND

1. Technical Field

This disclosure relates to an air duct and an air flow system.

2. Related Art

An air duct is formed from a synthetic resin or the like, and the air passes through the inside thereof. The air duct is used as a part of a stretch of duct system or air flow system, such as an intake system of an internal combustion engine for a car, an air-conditioning system or a cooling air delivery system. In such a duct system, a duct having a duct wall formed from a non-air-permeable material is typically used. Therefore, noise generated from a noise source such as an engine, a fan or a motor propagates inside the duct. Air column resonance occurs in the duct system. Thus, there has been a demand for reducing noise.

A technique for reducing noise propagating through a duct system, which has been developed or put into practical use, includes the provision of a large-diameter chamber section or the provision of a resonance-type silencer such as a Helmholtz resonator. Further, a technique so-called "porous duct" has also been developed in the art as a technique for giving air permeability to a portion of the duct wall. According to this technique, an air-permeable portion is provided in the duct wall formed from a non-air-permeable material. A porous duct is an attempt to reduce noise propagating through the duct by preventing the air column resonance in the duct system. Further, a technique of making a hole in the duct wall so as to prevent air column resonance (i.e., a tuning hole) has been also known.

As a porous duct, a technique described in JP-A-2001-323853, for example, is known in the art. A characteristic feature of this technique lies in a porous material, such as a non-woven fabric, having a moderate air-permeability attached to a duct wall so as to cover a hole provided in the middle section of the non-air-permeable duct wall. Thus, the space inside the duct and the outside space are brought into communication with each other through the porous material. Moreover, a porous duct described in JP-A-2001-323853 includes a non-woven fabric that is heat-welded to an opening at the end of a small tubular portion that is provided so as to project from the wall surface of the duct body. With such a duct, it is possible to suppress the occurrence of air column resonance in the duct system by adjusting the air permeability of the porous material. Thus, it is possible to reduce noise propagating through the duct system. This also provides an advantage that a non-woven fabric can be easily attached, and an advantage that the air flow resistance of the duct can be reduced.

According to a technique disclosed in JP-A-2009-281166, a synthetic resin duct having a duct wall formed from a thermoplastic resin is firstly molded. Then, at least a portion of the duct wall is processed as a laser light-irradiated portion. That is, a small aperture section, which includes a plurality of small apertures formed to be lined in an array by a laser drilling process, is formed in the irradiated portion.

According to this technique, the air column resonance of the duct can be prevented, and thus the noise propagating through the duct can be reduced.

SUMMARY

An air duct of this disclosure includes: a tubular duct body formed from a non-air-permeable material; and a tubular opening end member formed from an air-permeable material. The opening end member is integrated with an end portion of the duct body so as to extend a duct wall of the duct body. D representing a diameter of the opening end member and L representing a length thereof satisfy a relationship $0.1D \leq L \leq 1.5D$. An air permeability of the air-permeable material is in a range of 0.3 to 100 sec/300 cc.

DETAILED DESCRIPTION

Figure 1:
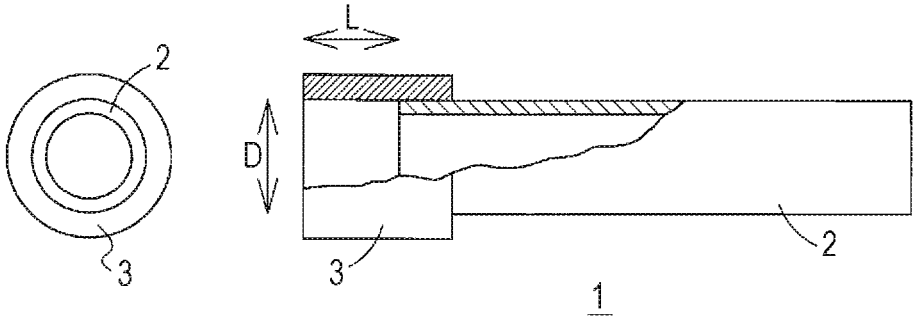
FIG. 1 is a diagram illustrating an air duct according to a first embodiment of this disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The techniques described in JP-A-2001-323853 and JP-A-2009-281166 are both capable of suppressing air column resonance of a duct. With either technique, however, it is necessary to provide holes in a duct wall in the middle section of the duct. Therefore, an air leaks out or comes in through the holes provided in the duct wall. For example, if such a conventional duct is used as an air intake duct for supplying an air into a car engine, an air having been heated in an engine room enters the air intake duct through the holes provided in the duct wall. This may increase the intake air temperature, leading to a decrease in the power of the engine.

That is, the conventional air ducts of JP-A-2001-323853 and JP-A-2009-281166 have an opening that is provided at a certain area other than the position (e.g., an intake port at the tip of the duct for an air intake duct for an engine) at which an air is supposed to be taken in. Therefore, a problem arises that an air moves between the inside and the outside of the duct through the opening.

An object of this disclosure is to provide an air duct capable of suppressing the duct air column resonance by using a technical means that is different from these conventional techniques, while suppressing the movement of an air between the inside and the outside of the duct in a middle section of the duct.

The inventors have found as a result of earnest studies that the above problem can be solved by an air duct configured as follows, and thus completed the air duct of this disclosure. That is, this air duct includes a tubular duct formed from a non-air-permeable material. A tubular member (opening end member) formed from a particular air-permeable material is integrated at the end portion of the duct. At the end portion of the air duct, this opening end member can be open into the atmospheric air or an expanded space.

An air duct of this disclosure includes: a tubular duct body formed from a non-air-permeable material; and a tubular opening end member formed from an air-permeable material, in which the opening end member is integrated with an end portion of the duct body so as to extend a duct wall of the duct body, D representing a diameter of the opening end member and L representing a length thereof satisfy a relationship $0.1D \leq L \leq 1.5D$, and an air permeability of the air-permeable material is in a range of 0.3 to 100 sec/300 cc (the first embodiment).

In the first embodiment, the thickness of the air-permeable material of the opening end member may be in a range of 0.5 to 5 mm (the second embodiment). Moreover, in the second embodiment, a reinforcement body may be integrated with the opening end member (the third embodiment). Alternatively, in the third embodiment, a partial area of the opening end member in the circumferential direction may be covered with a non-air-permeable material (the fourth embodiment).

With the air duct of this disclosure (the first embodiment), the air column resonance of the duct can be suppressed, and it is therefore possible to suppress an increase in duct noise at a particular frequency. In the air duct of the first embodiment, an air-permeable opening end member is provided at an open end of the air duct. Thus, it is possible to suppress the movement of an air through a middle section of the duct.

According to the second embodiment, although the thickness of the air-permeable material of the opening end member is as small as 0.5 to 5 mm, it is possible to suppress air column resonance of the duct over a frequency range of 1000 Hz or less. According to the third embodiment, a reinforcement body is integrated with the opening end member. Therefore, it is possible to prevent deformation of the opening end member. According to the fourth embodiment, a partial area of the opening end member in the circumferential direction is covered with a non-air-permeable material. Therefore, it is possible to control the direction of propagation of the sound which is radiated through the opening end member. Thus, by blocking the direction where the sound is not desirable to be transmitted by using the non-air-permeable material, it is possible to further reduce the amount of noise to be perceived propagating through the duct.

The embodiments of this disclosure will be described below with reference to the drawings, by exemplifying an air intake duct through which an air to be supplied to a car engine flows. The disclosure is not limited to the specific embodiments described below. The embodiments can be modified. FIG. 1 illustrates an air duct 1 according to the first embodiment of this disclosure. In FIG. 1, a part of a front view is shown in a cross-sectional view. The air duct 1 includes a duct body 2 and an opening end member 3. They are connected in series with each other. The air duct 1 is a tubular duct. The air duct 1 of the present embodiment is a straight pipe-shaped duct having a cylindrical cross section. Note that, however, the cross section of the duct may be any other shape such as rectangular. The shape of the duct may be a bent-pipe shape where the duct is bent, for example. The air duct 1 may include an attachment member or a silencer (e.g., a resonance-type silencer) as necessary.

The duct body 2 is formed in a tubular shape from a non-air-permeable material. Examples of the non-air-permeable material include a thermoplastic resin, a thermosetting resin, a rubber, and a metal. The duct body 2 of the present embodiment is obtained by blow-molding a polypropylene resin.

The opening end member 3 is integrated at one end of the duct body 2. The integration may be done by bonding, adhesion or welding, as well as insert molding, or mechanical attachment (attachment through engaging or locking) by means of a snap-in (fit-in), a band, or a pin. The opening end member 3 and the duct body 2 may be attached and integrated together so that there is no gap therebetween, by fitting them together. There is no particular limitation as long as the opening end member 3 is integrated at the end of the duct body 2. The opening end member 3 may be provided only at one end of the duct body 2. Alternatively, the opening end member 3 may be provided at both ends of the duct body 2.

The opening end member 3 is formed from an air-permeable material. Examples of the air-permeable material include a non-woven fabric, a foamed resin (foam sponge), and a filter paper. When a foamed resin is used, one may use a foamed resin having an open-celled structure. When the air-permeable material is a filter paper or a non-woven fabric, the air permeability may be adjusted by impregnating it with a binder, or the like. With the binder with which the material is impregnated, it is possible to increase the stiffness of the material, and to increase the shape retention property of the opening end member 3. In the present embodiment, the tubular opening end member 3 is formed from processing a non-woven fabric.

The tubular opening end member 3 is formed so as to extend the duct wall of the duct body 2. In the present embodiment, the inner surface of the tubular opening end member 3 has a generally equal diameter D to the outer surface of the duct body 2. The duct body 2 and the opening end member 3 are fitted together. The opening end member 3 may be shaped in a funnel shape by increasing the diameter of the end portion of the opening end member 3 by using a heat press shaping process, or the like.

A portion of the duct wall of the air duct 1 that is the opening end member 3 forms an air-permeable duct wall. The duct body 2 portion forms a non-air-permeable duct wall. The air duct 1 is used in a part of an intake system for supplying an air into a car engine. The air duct 1 of the present embodiment can be used as a part of an air intake duct for guiding an air from the open atmospheric air into an air cleaner of an intake system. In such a case, the air duct 1 is used in such a manner that the opening end member 3 is located on the side of the intake port of the air intake duct for sucking in an air from the open atmospheric air.

In a case where an expanded space such as an expansion chamber or an air cleaner is provided in the air flow passage of the intake system, the air duct 1 can be used in such a manner that the opening end member 3 is exposed in the expanded space. That is, the opening end member 3 of the air duct 1 can be integrated with the duct body 2 so that the opening end member 3 is located in the intake system on one side of the air duct 1 that is open into the atmospheric air or the expanded space.

The shape of the opening end member 3 will be described in more detail. D representing the diameter of the opening end member 3 and L representing the length thereof satisfy the relationship $0.1D \leq L \leq 1.5D$. More specifically, the diameter D refers to the representative diameter of the cross section of the tubular opening end member 3. The diameter D corresponds to the diameter of a circular cross section, the length of the major axis of an elliptical cross section, and the length of the long side of a rectangular cross section. As illustrated in FIG. 1, the length L refers to the length in the pipe axis direction of a portion of the opening end member 3 that is not covered with a non-air-permeable duct body 2. The diameter D and the length L may be set so as to satisfy $0.25D \leq L \leq 1.3D$, and particularly $0.5D \leq L \leq 1.2D$. If the relationship $0.1D \leq L$ is satisfied, it is possible to suppress the resonance over a frequency range of 400 Hz to 1000 Hz. If the relationship $0.25D \leq L$ is satisfied, it is possible to effectively suppress also the resonance at frequencies of 400 Hz or less. Note that, however, further increasing the length L of the air-permeable portion ($L > 1.5D$) provides no further significant improvement to the resonance suppressing effect. L being excessive is disadvantageous in terms of retaining the shape of the portion of the opening end member 3 and suppressing the intake of a hot air.

The air permeability of the air-permeable material of the opening end member 3 will be described. The air permeability of the air-permeable material is in a range of 0.3 to 100 sec/300 cc. The air permeability can be measured by a method in conformity with the Gurley test method defined in JIS P8117. The air permeability may be in a range of 0.5 to 10 sec/300 cc. The air permeability can be adjusted so as to be within such a range by utilizing a binder, a heat press, or the like, as necessary. The opening end member 3 can be molded by using an air-permeable material such as a non-woven fabric whose air permeability is adjusted as described above.

The thickness of the air-permeable material of the opening end member 3 can be set in a range of 0.5 to 5 mm. According to the present embodiment, it is possible to suppress the resonance phenomenon over a frequency range of 1000 Hz or less, despite such a small thickness of the air-permeable material. With a thin air-permeable material, the air duct 1 can provide a good space-conserving property.

The air duct 1 described above can be manufactured by a known manufacturing method. For example, the opening end member 3 can be produced by cutting a non-woven fabric into a strip, rolling up the strip into a cylindrical shape with its ends overlapping each other, and bonding or welding the overlap portion.

The functions and effects of the air duct 1 of the present embodiment will be described.

With the air duct 1, it is possible to suppress air column resonance occurring in a stretch of air flow passage configured so as to include the air duct 1 therein. The functions and effects of the air duct 1 will now be described, with reference to test results obtained by using a straight-pipe duct having a diameter of 80 mm and a length of 700 mm.

Figure 4:
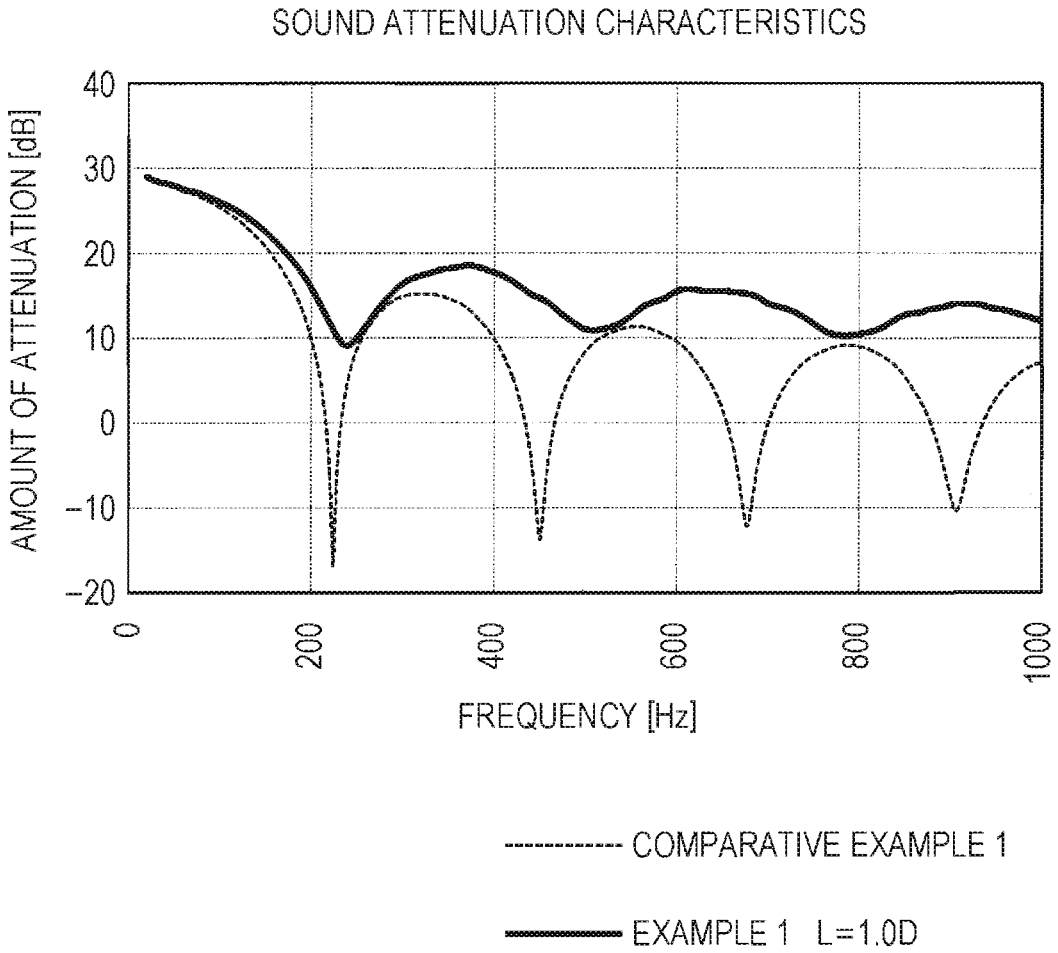
FIG. 4 is a graph illustrating the silencing effect of the air duct according to the first embodiment of this disclosure.

FIG. 4 illustrates a comparison between a test result for an example (Example 1) using the air duct 1 of the first embodiment, which includes the opening end member 3 having a length L and a diameter D satisfying $L=1.0D$ ($L=80$ mm), and a test result obtained by using an ordinary straight pipe (Comparative Example 1) with no opening end member. In Example 1, a non-woven fabric having an air permeability of 3 sec/300 cc and a thickness of 1.5 mm was used as the material of the opening end member.

Figure 10:
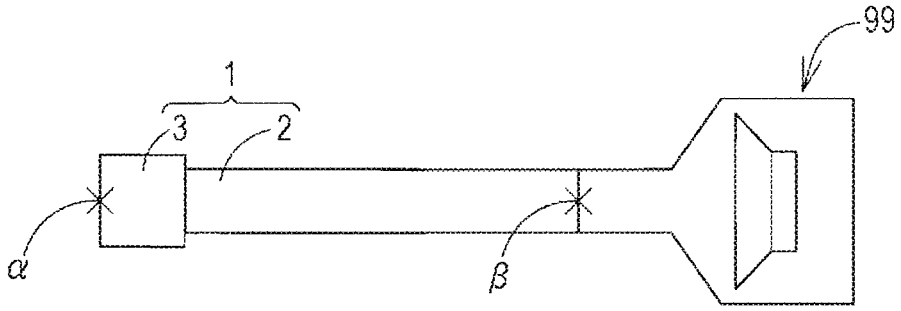
FIG. 10 is a schematic diagram illustrating a method for measuring the amount of sound attenuation.

The measurement results of the amount of sound attenuation as illustrated in FIG. 4 are obtained by a test as illustrated in FIG. 10. As illustrated in FIG. 10, the air duct 1 to be tested is connected to a noise generator 99. Noise generated by the speaker of the noise generator 99 propagates through the air duct 1. Noise is radiated into the open atmospheric air from the opening of the air duct 1 provided with the opening end member 3. The sound pressure level $P\alpha$ of noise is measured at the position (position $\alpha$ in the figure) at which the air duct 1 is open into the open atmospheric air. The sound pressure level $P\beta$ of noise is measured at the position (position $\beta$ in the figure) at which the air duct 1 is connected to the noise generator. The amount of sound attenuation $P\beta/P\alpha$ is calculated by performing a frequency analysis of the measured sound pressure. The amount of sound attenuation represents the degree by which noise decreases while passing through the duct. A larger amount of sound attenuation indicates that noise has more attenuated and it became quieter.

As illustrated in FIG. 4, Comparative Example 1 using an ordinary straight pipe has troughs, where the amount of sound attenuation decreases significantly, in the vicinity of 225 Hz, 450 Hz, 675 Hz and 900 Hz. These represent the presence of air column resonance. These troughs correspond to the primary, secondary, third-order and fourth-order air column resonance modes, respectively, of a pipe with open ends. Air column resonance occurs at frequencies at which the length of the pipe is n/2 (n=1, 2, . . . ) of the wavelength $\lambda$ of the sound. At frequencies at which air column resonance occurs, the amount of sound attenuation is small, and noise problems are likely to occur.

As illustrated in FIG. 4, with the air duct 1 of Example 1 provided with the opening end member 3 satisfying $L=1.0D$, the drop of the amount of sound attenuation is suppressed even in the vicinity of frequencies at which air column resonance occurs. Thus, the occurrence of air column resonance is suppressed.

A presumed mechanism of suppressing air column resonance in the present embodiment will be described below. With the air duct 1 of the first embodiment, the opening end member 3, which has a particular air permeability and a particular length, is provided at an end of the duct body 2. Thus, the pipe length of the air duct 1 becomes ambiguous acoustically. The straight pipe of Comparative Example 1 has an acoustically unambiguous pipe length. As a result, the resonant frequency of the pipe is defined clearly, thereby causing a strong air column resonance. On the other hand, in the air duct 1 of Example 1, part of the air movement between the inside of the duct body 2 and the open atmospheric air occurs through the opening end member 3. The rest of the air movement occurs through the opening at the end of the opening end member 3. Thus, the position at which the air flows into and out of the open atmospheric air (outside air) is ambiguous. This makes ambiguous the acoustic pipe length of the air duct 1. This also makes ambiguous the resonant frequency, which is determined by the acoustic pipe length. Thus, the occurrence of a strong air column resonance is suppressed.

This mechanism of suppressing air column resonance of this disclosure is based on a different principle from that of the mechanism of suppressing resonance using known techniques. This will be described below.

Figure 5:
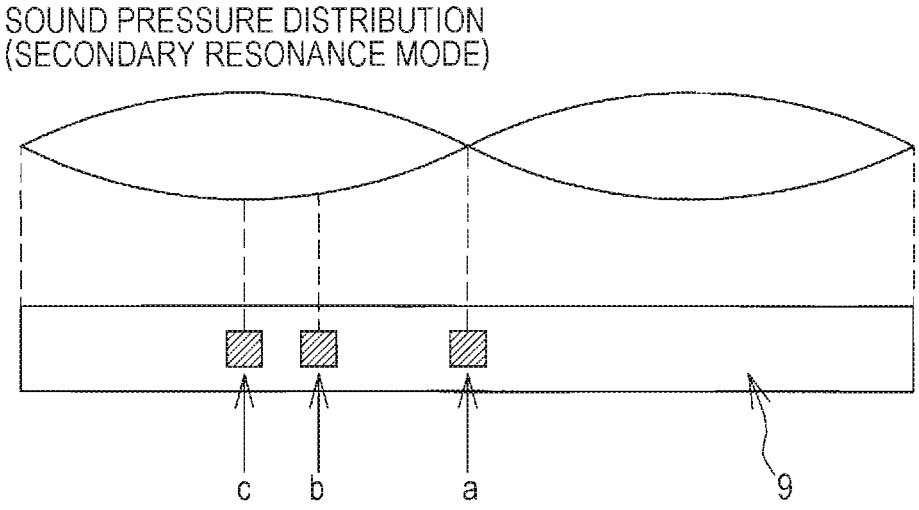
FIG. 5 is a diagram illustrating the relationship between the position of a hole and a resonance mode of the air column resonance in the air duct.

A technique of providing a hole in a part of a duct and providing a porous material in the hole (so-called a "porous duct technique") is known, as with the technique of JP-A-2001-323853. Also with this technique, it is possible to suppress air column resonance. FIG. 5 illustrates the relationship between the sound pressure distribution in the secondary resonance mode of a duct 9, and the position along the duct 9 at which a hole or a porous member is provided (the position at which the duct is attached with a porous member). A position 'a' is located at ½ the entire length of the duct 9, a position 'b' at ⅓ the entire length of the duct 9, and a position 'c' at ¼ the entire length of the duct 9. Comparative Example 2 was carried out using a porous duct with a hole and a porous material provided at the position 'a'. Comparative Example 3 was carried out using a porous duct with a hole and a porous material provided at the position 'b'. Comparative Example 4 was carried out using a porous duct with a hole and a porous material provided at the position 'c'.

Figure 6:
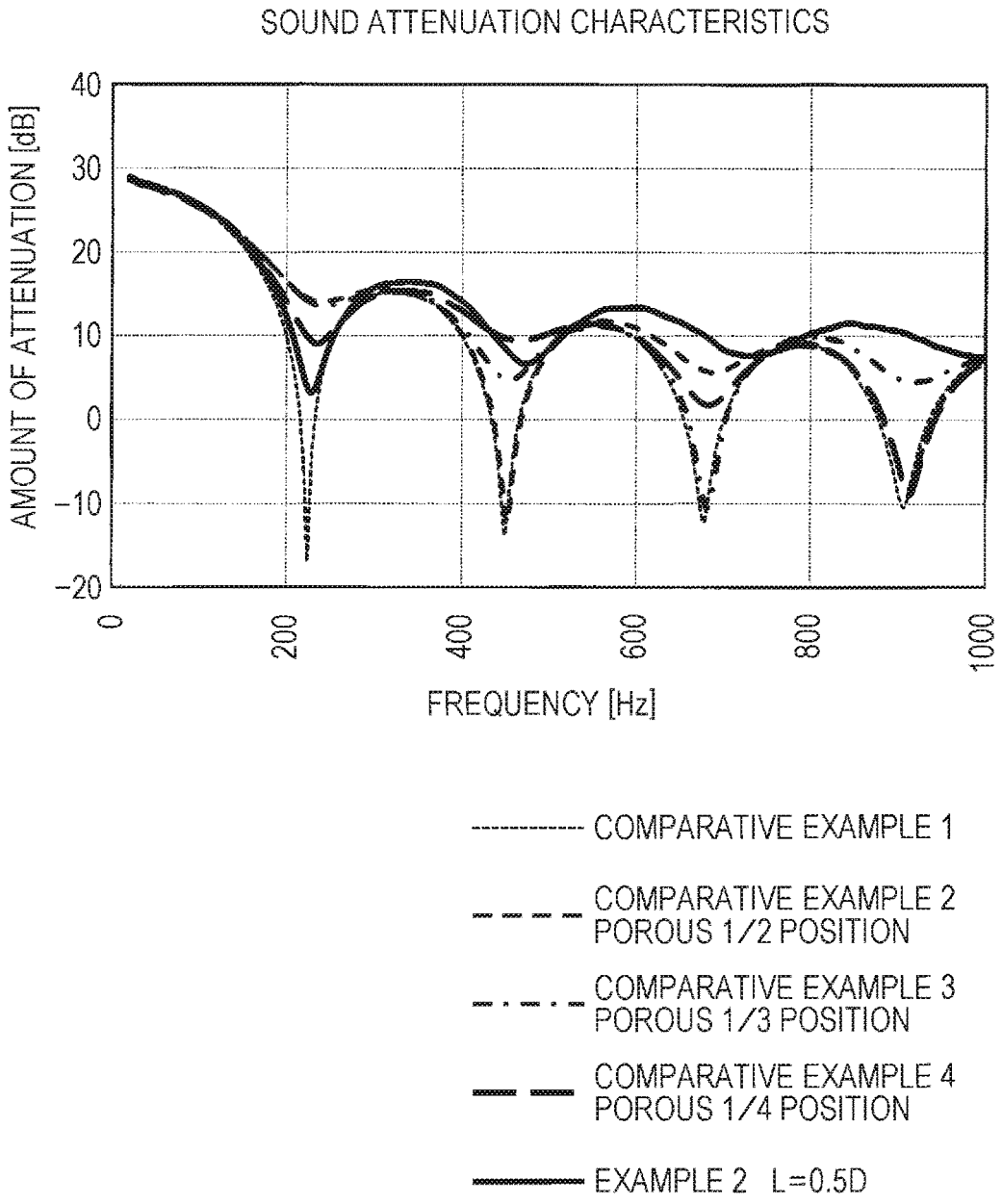
FIG. 6 is a graph illustrating the variation of the silencing effect depending on the position of the hole of the air duct, as shown by Examples and Comparative Examples of this disclosure.

FIG. 6 illustrates a result of comparing the amounts of sound attenuation. FIG. 6 illustrates a comparison among the amount of sound attenuation of an air duct 1 (Example 2) having the same opening end member 3 as that of Example 1 except that L=0.5D is satisfied, that of an ordinary straight pipe (Comparative Example 1), and those of porous ducts (Comparative Examples 2, 3 and 4). Note that in Comparative Examples 2, 3 and 4, the size of the hole and the porous material was set to be equal to D and L of the opening member of Example 2 satisfying L=0.5D.

As illustrated in FIG. 5, the porous duct technique is based on the principle that resonance is made less likely to occur by allowing the pressure to be relieved by making a hole at a position at which the sound pressure is increased by resonance (particularly, an antinode of the resonance mode). Thus, with a porous duct, it is possible to realize the resonance-suppressing effect if the position of the node of the resonance mode when resonance occurs is shifted from the position at which a hole or a porous member is provided. However, when a hole or a porous member is provided at a position corresponding to a node during resonance, the resonance suppressing effect is not substantially realized. For example, for a secondary resonance mode illustrated in FIG. 5, the effect can be expected if a hole or a porous member is provided at the position 'b' or position 'c'. However, the resonance prevention effect cannot be expected when providing a hole or a non-woven fabric at the position 'a', which corresponds to the node.

As a result, in Comparative Example 2, the position 'a' corresponds to the node of the resonance mode at secondary resonance (450 Hz) and fourth-order resonance (900 Hz), as illustrated in FIG. 6. Therefore, substantially no resonance suppressing effect is realized. In Comparative Example 3, the position 'b' corresponds to the node of the resonance mode at third-order resonance (675 Hz). Therefore, substantially no resonance suppressing effect is realized. In Comparative Example 4, the position 'c' corresponds to the node of the resonance mode at fourth-order resonance (900 Hz). Therefore, substantially no resonance suppressing effect is realized. The above description is directed to the principle and the effect of the suppression of air column resonance by using a porous duct technique. Note that the open end of the duct 9 is a position corresponding to a node of every resonance mode. Therefore, even if a hole or a non-woven fabric is provided at this position, it cannot be expected that air column resonance is suppressed based on the principle of the porous duct technique.

On the other hand, in Example 2, there is obtained the effect of suppressing resonance for all resonant frequencies.

It is not impossible, but is practically difficult, to suppress air column resonance by means of an ordinary sound-absorbing material such as a glass wool. The silencing principle of an ordinary sound-absorbing material is based on a principle that a vibrating air flow movement by a generated sound is attenuated by the resistance of a minute structure such as the fiber of the sound-absorbing material, thereby dissipating the sound energy. Due to this principle, it is necessary to provide a sound-absorbing material having a large area and a larger thickness, depending on the frequency of the sound to be silenced, so that the sound-absorbing material is arranged at a position where there is a significant movement of the air. That is, if the sound-absorbing material is thin, the silencing effect at the lower frequency cannot be expected.

Figure 7:
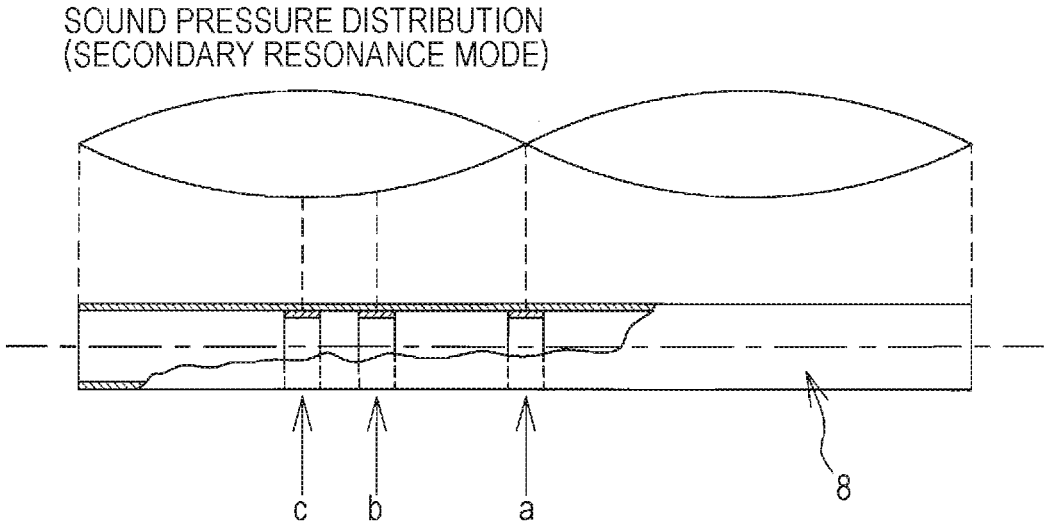
FIG. 7 is a diagram illustrating the relationship between the position of a sound-absorbing material and the resonance mode of the air column resonance in the air duct.

FIG. 7 illustrates the relationship between the sound pressure distribution of the secondary resonance of a duct 8 and the position at which the sound-absorbing material is provided on the inner surface of the duct. A position 'a' is located at ½ the entire length of the duct 8, a position 'b' at ⅓ the entire length of the duct 8, and a position 'c' at ¼ the entire length of the duct 8. In Comparative Examples 5 to 7, a tubular glass wool sound-absorbing material was provided on the inner surface of the duct 8. In Comparative Example 5, the sound-absorbing material was provided at the position 'a'. In Comparative Example 6, the sound-absorbing material was provided at the position 'b'. In Comparative Example 7, the sound-absorbing material was provided at the position 'c'. Note that the thickness of the sound-absorbing material was set to 1.5 mm. The length L in the pipe axis direction of the portion where the tubular sound-absorbing material is provided and the diameter D thereof satisfy L=0.5D.

Figure 8:
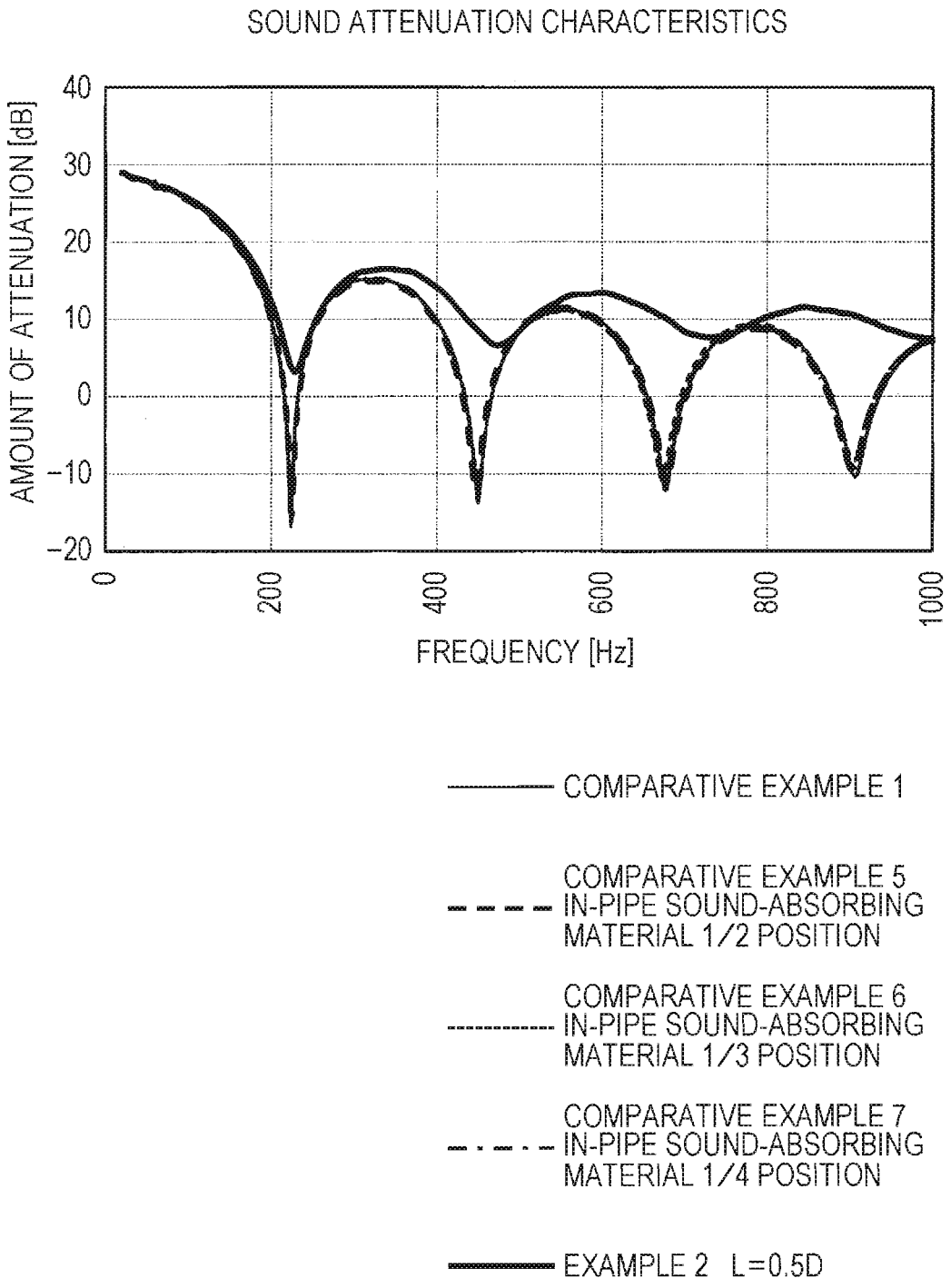
FIG. 8 is a graph illustrating the variation of the silencing effect depending on the position of the sound-absorbing material of the air duct, as shown by Examples and Comparative Examples of this disclosure.

As indicated in the sound attenuation characteristics of FIG. 8, a sound-absorbing material having a thickness of about 1.5 mm shows substantially no resonance suppressing effect for any resonance, irrespective of whether the sound-absorbing material is provided at the position 'a', position 'b' or position 'c'. Generally, with a sound-absorbing material having a thickness of 5 mm or less, substantially no silencing effect can be expected at 1000 Hz or less. In Example 2, however, even though the thickness of the opening end member 3 is as small as 1.5 mm, the effect of suppressing air column resonance is obtained.

As described above, the resonance suppressing effect of this disclosure is obtained based on a principle that is different from either the resonance-suppressing principle of a so-called porous duct or the silencing principle of a sound-absorbing material, which are conventional techniques. That is, the effect is obtained based on the principle that a strong resonance no longer occurs as the acoustic pipe length becomes ambiguous. Therefore, it is possible to suppress air column resonance in an air duct even though an opening end member of an air-permeable material is provided at such a position with such a thickness that the effect cannot possibly be expected based on a conventional principle.

Figure 9:
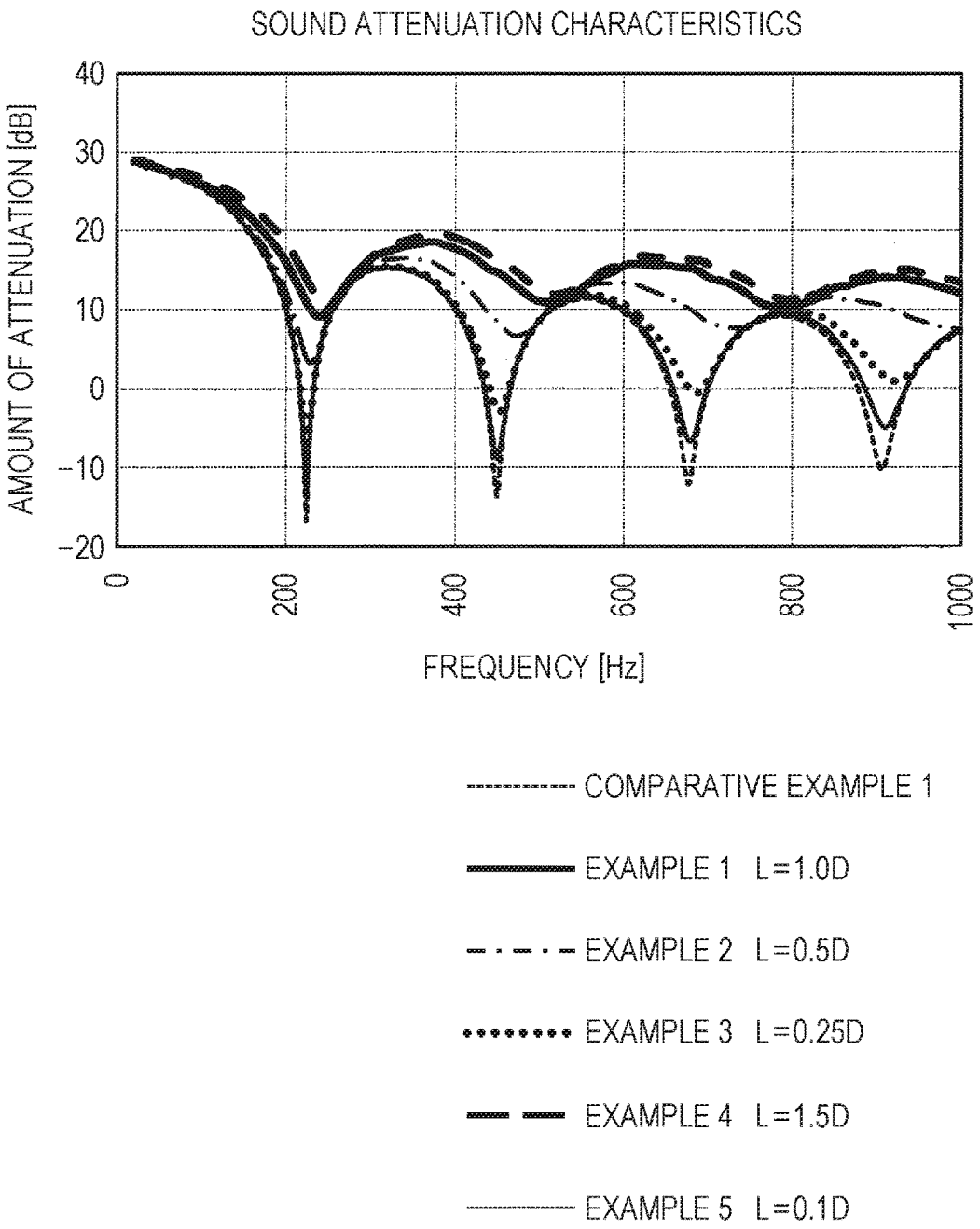
FIG. 9 is a graph illustrating the silencing effect obtained when varying the length of the opening end member of the air duct according to the first embodiment of this disclosure.

FIG. 9 illustrates the variation of the amount of sound attenuation when varying the length L of the opening end member 3 of Example 1 (the length of the air-permeable portion of the air duct 1, which is obtained by attaching the opening end member 3 to the duct body 2). When L=0.25D (Example 3) is satisfied, occurrence of a strong air column resonance is suppressed, as compared with an ordinary straight pipe (Comparative Example 1). That is, a significant effect of suppressing air column resonance is obtained. The effect of suppressing air column resonance improves by increasing L with respect to D. Note that, however, the effect of suppressing air column resonance does not improve so much when L exceeds 1.0D (Example 1) and L=1.5D (Example 4) is satisfied. At L=0.1D (Example 5), not so much effect is observed for resonance at 225 Hz. However, the resonance suppressing effect is observed for resonance at 450 Hz, 675 Hz and 900 Hz.

Therefore, in order to reduce the size of the opening end member while suppressing air column resonance at 400 Hz or more and 1000 Hz or less, D and L can be set so that $0.1D \leq L \leq 1.5D$ is satisfied. In order to effectively suppress resonance at 400 Hz or less, D and L can be set so that $0.25D \leq L \leq 1.5D$ is satisfied.

Figure 11:
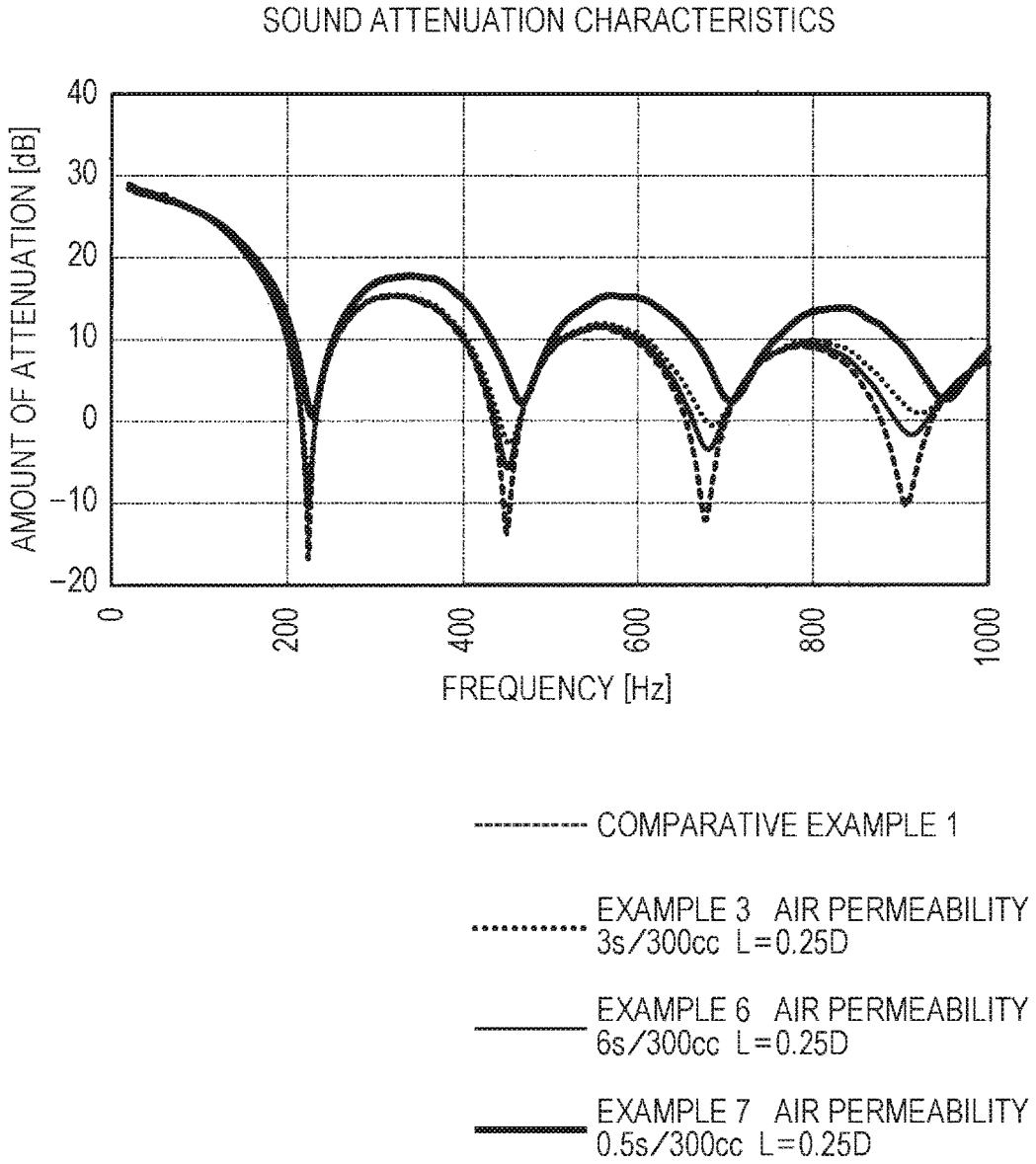
FIG. 11 is a graph illustrating the silencing effect obtained when varying the air permeability of the air-permeable material of the opening end member of the air duct according to the first embodiment of this disclosure.

FIG. 11 illustrates the variation of the amount of sound attenuation when varying the air permeability of the air-permeable material of the opening end member 3 of the air duct 1 of the first embodiment. Examples 3, 6 and 7 were each carried out by using the air duct 1 having the opening end member 3 satisfying L=0.25D and having a thickness of 1.5 mm. A comparison was made between the sound attenuation characteristics of respective air-permeable materials having an air permeability of 3 sec/300 cc (Example 3), 0.5 sec/300 cc (Example 7) and 6 sec/300 cc (Example 6). Between these examples, Example 7, which used an air-permeable material having an air permeability of 0.5 sec/300 cc, showed the most desirable resonance suppressing effect. As shown in these examples, the air permeability of the air-permeable material can be set particularly in a range of 0.5 to 10 sec/300 cc.

This disclosure is not limited to the embodiment described above. Other embodiments realized by making various modifications to the above embodiment shall fall within the scope of this disclosure. Other embodiments of this disclosure will be described below. The description below focuses on what is different from the embodiment described above. Detailed description of the same parts as those of the embodiment described above will be omitted. Embodiments realized by combining together parts of the embodiments below, and embodiments realized by substituting parts of the embodiments below with parts of other embodiments, shall also fall within the scope of this disclosure.

Figure 2:
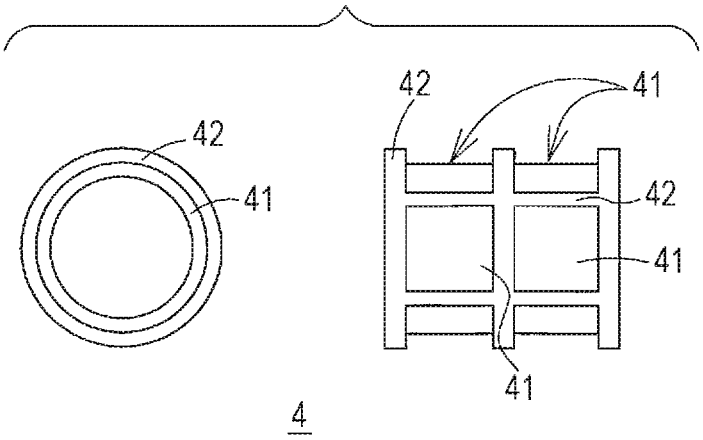
FIG. 2 is a diagram illustrating a second embodiment of an opening end member.

A variation of the opening end member used in the embodiment of this disclosure will be described. An opening end member 4 shown in FIG. 2 includes a reinforcement body 42 for suppressing deformation. The opening end member 4 is integrated with the duct body 2, as is the opening end member 3 of the first embodiment, thereby forming the air duct 1. Thus, the opening end member 4 provides the same effect as the opening end member 3. The reinforcement body 42 is integrated with the outer surface of a cylindrical opening end member body 41 formed from an air-permeable material. The reinforcement body 42 may include ring-shaped portions spaced apart from one another by a predetermined interval so as to suppress collapse of the opening end member 4. In the present embodiment, the reinforcement body 42 is formed in a lattice shape so as to have ring-shaped portions spaced apart from one another by a predetermined interval in the axial direction. The reinforcement body 42 is formed from a synthetic resin. The reinforcement body 42 is integrated with the opening end member body 41 by welding or bonding. Note that the reinforcement body 42 may be formed to be as thin as possible so as not to detract from the air permeability of the opening end member body 41.

Figure 3:
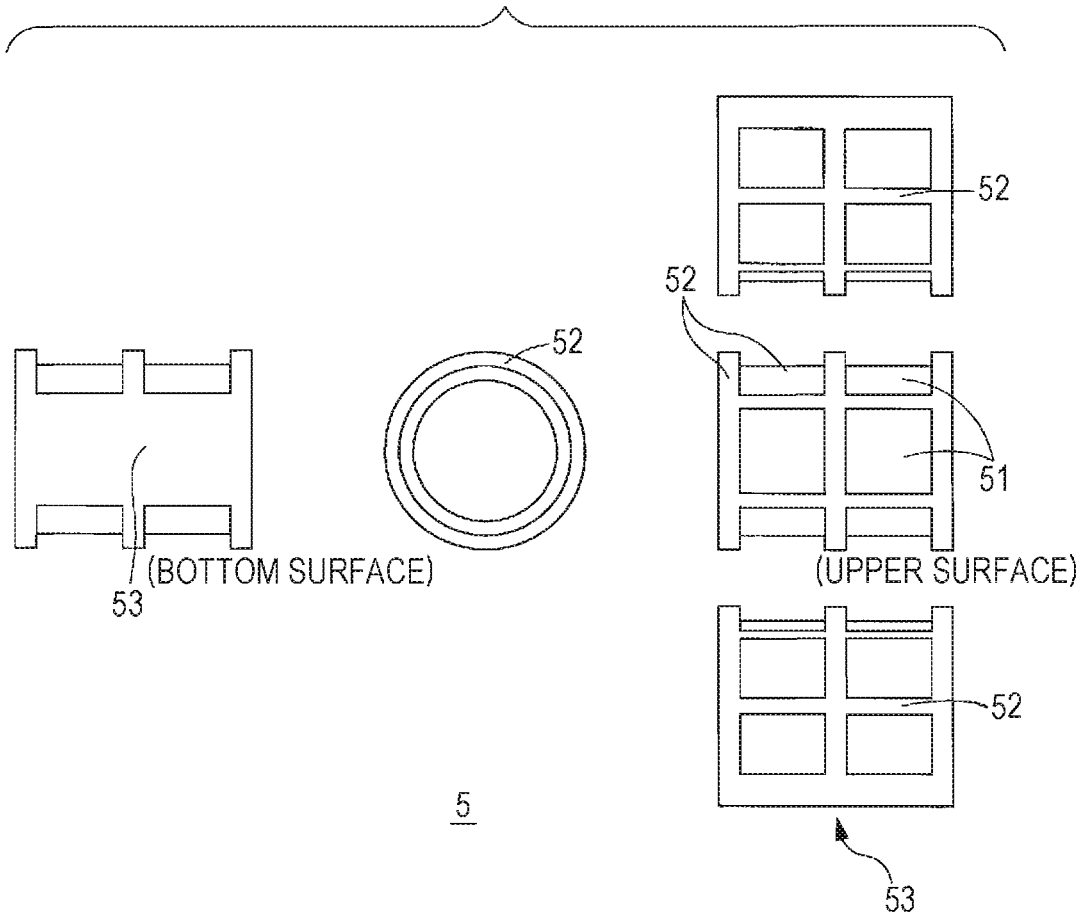
FIG. 3 is a diagram illustrating a third embodiment of an opening end member.

Another variation of the opening end member will be described. FIG. 3 illustrates an opening end member 5 of which a partial area in the circumferential direction is covered with a non-air-permeable material. The opening end member 5 includes a reinforcement body 52 of a non-air-permeable material. On the upper surface and the side surface of the opening end member 5, an opening end member body 51, which is covered with the lattice-shaped reinforcement body 52, is mostly exposed. On the bottom surface of the opening end member 5, a covered portion 53 is formed from a non-air-permeable material of the reinforcement body 52. The covered portion 53 covers the opening end member body 51.

By using the opening end member 5 in a similar manner to that of the opening end member 3 of the air duct 1 of the first embodiment, it is possible to realize the same effect of suppressing air column resonance as the first embodiment. Moreover, since a partial area of the opening end member 5 in the circumferential direction is covered with the covered portion 53 of a non-air-permeable material, noise is less likely to be radiated in the direction toward the covered portion from inside the duct. Thus, it is possible to control the direction in which sound, which is radiated through the opening end member 5, propagates. Therefore, by covering the direction, in which the sound is not desirable to be transmitted, with a non-air-permeable material, it is possible to further reduce the amount of noise to be perceived propagating through the duct. The covered portion 53 can cover an area of the opening end member 5 that is ⅙ to ½ of the opening end member 5 in the circumferential direction. The covered portion 53 may be provided so as to cover the opening end member body 51 over the entire length of the opening end member 5.

The above description focuses on the example where the opening end member 3 of the air duct 1 faces the open atmospheric air. Note that, however, examples of air ducts of this disclosure are not limited thereto. For example, a similar resonance suppressing effect is obtained also when the opening end member 3 of the air duct 1 is provided so that the opening end member 3 projects into the inside (expanded space) of an air cleaner or an expansion chamber connected to the air duct 1. A plurality of opening end members may be provided both on the end of the air duct facing the open atmospheric air and the end thereof projecting into the expansion chamber.

The air duct of this disclosure may include a so-called "drain hole" or "tuning hole". The air duct of this disclosure may include a resonance-type silencer such as a Helmholtz resonator or a ¼ wavelength resonance tube (side branch).

The embodiment described above is directed to an example where the air duct is used as the air intake duct of a car engine. However, the application of the air duct is not limited thereto. The air duct can be used in air flow systems in general. For example, the air duct of this disclosure can be used as an air duct forming a part of a battery cooling system for sending a cooling air to a battery (pack) assembly carried on a hybrid car or an electric car. The air duct of this disclosure can also be used as an air duct forming a part of an air flow passageway for sending an air in an air-conditioning system.

An air duct including an opening end member has a high industrial applicability as it can be used in ducts for sending an air in general.

The air duct of this disclosure may be any of first to fourth air ducts below.

The first air duct is an air duct including a duct body formed from a non-air-permeable material in a tubular shape, and an opening end member integrated with an end portion of the duct body, wherein: the opening end member is formed from an air-permeable material in a tubular shape such as to extend a duct wall of the duct body; the opening end member is integrated on a side on which the air duct is open into an atmospheric air or an expanded space; $0.1D \leq L \leq 1.5D$ is satisfied where D is a diameter and L is a length of the opening end member; and an air permeability of the air-permeable material of the opening end member is in a range of 0.3 to 100 sec/300 cc as measured by a method in conformity with the Gurley test method defined in JIS P8117.

The second air duct is according to the first air duct, wherein a thickness of the air-permeable material of the opening end member is in a range of 0.5 to 5 mm.

The third air duct is according to the second air duct, wherein a reinforcement body is integrated with the opening end member.

The fourth air duct is according to the second air duct, wherein a partial area of the opening end member in a circumferential direction is covered with a non-air-permeable material.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An air duct comprising:

a tubular duct body formed from a non-air-permeable material; and a tubular opening end member formed from an air-permeable material, wherein:

the opening end member is integrated with an end portion of the duct body so as to extend a duct wall of the duct body;

the air duct has an opening at an end of the opening end member, the end of the opening end member being opposite to other end at which the opening end member is integrated with the end portion of the duct body in a direction of an axis of the opening end member;

D representing a diameter of the opening end member and L representing a length thereof satisfy a relationship $0.1D \leq L \leq 1.5D$; and an air permeability of the air-permeable material is in a range of 0.3 to 100 sec/300 cc.

2. The air duct according to claim 1, wherein a thickness of the air-permeable material is in a range of 0.5 to 5 mm.

3. The air duct according to claim 1, comprising a reinforcement body integrated with the opening end member.

4. The air duct according to claim 1, wherein a partial area of the opening end member in a circumferential direction is covered with a non-air-permeable material.

5. An air flow system comprising an air duct according to claim 1, wherein the opening end member is located at an intake port for sucking in an air from an open atmospheric air.

6. An air flow system comprising an air duct according to claim 1, and an expanded space provided in an air flow passage, wherein the opening end member is exposed in the expanded space.

* * * * *